US009848266B2

(12) United States Patent
Buyens

(10) Patent No.: US 9,848,266 B2
(45) **Date of Patent: *Dec. 19, 2017**

(54) PRE-PROCESSING OF A CHANNELIZED MUSIC SIGNAL

(71) Applicant: Cochlear Limited, Macquarie University (AU)

(72) Inventor: Wim Buyens, New South Wales (AU)

(73) Assignee: Cochlear Limited, Macquarie University, NSW (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/294,400

(22) Filed: Oct. 14, 2016

(65) Prior Publication Data

US 2017/0034624 A1 Feb. 2, 2017

Related U.S. Application Data

(63) Continuation of application No. 14/329,518, filed on Jul. 11, 2014, now Pat. No. 9,473,852.
(Continued)

(51) Int. Cl.
*H04S 3/00* (2006.01)
*H04R 5/04* (2006.01)
(Continued)

(52) U.S. Cl.
CPC ..... *H04R 5/04* (2013.01); *H04R 25/43* (2013.01); *H04R 25/552* (2013.01); *H04S 1/005* (2013.01);
(Continued)

(58) Field of Classification Search
CPC . H04R 5/00; H04R 5/033; H04R 5/04; H04R 25/00; H04R 2430/03; H04S 3/004;
(Continued)

(56) References Cited

U.S. PATENT DOCUMENTS 6,405,163 B1 6/2002 Laroche
2002/0041693 A1 4/2002 Matsuo
(Continued)

FOREIGN PATENT DOCUMENTS

CN 101953176 A 1/2011
CN 102142259 A 8/2011
(Continued)

OTHER PUBLICATIONS

Yipeng Li et al., Separation of Singing Voice From Music Accompaniment for Monaural Recordings, IEEE Transactions on Audio, Speech and Language Processing, IEEE, vol. 15, No. 4, May 2007, pp. 1475-1487.
(Continued)

*Primary Examiner* — Brenda Bernardi

(57) ABSTRACT

A method for pre-processing a channelized music signal to improve perception and appreciation for a hearing prosthesis recipient. In one example, the channelized music signal is a stereo input signal. A device, such as a handheld device, hearing prosthesis, or audio cable, for example, applies a mask to a stereo input signal to extract a center-mixed component from the stereo signal and outputs an output signal comprised of a weighted combination of the extracted center-mixed component and a residual signal comprising a non-extracted part of the stereo input signal. The center-mixed component may contain components, such as leading vocals and/or drums, preferred by hearing prosthesis recipients relative to other components, such as backing vocals or other instruments.

20 Claims, 6 Drawing Sheets

Related U.S. Application Data

(60) Provisional application No. 61/845,580, filed on Jul. 12, 2013.

(51) Int. Cl.

| | |
|---|---|
| ***H04R 25/00*** | (2006.01) |
| ***H04S 5/00*** | (2006.01) |
| ***H04S 1/00*** | (2006.01) |
| *H04R 5/033* | (2006.01) |

(52) U.S. Cl.
CPC ..... *H04S 5/00* (2013.01); *G10H 2210/056* (2013.01); *G10H 2210/305* (2013.01); *H04R 5/033* (2013.01); *H04R 2205/041* (2013.01); *H04R 2430/03* (2013.01); *H04S 3/004* (2013.01); *H04S 2400/05* (2013.01); *H04S 2420/07* (2013.01)

(58) Field of Classification Search
CPC ..... H04S 5/00; H04S 5/033; H04S 2400/05; H04S 2420/07
See application file for complete search history.

(56) References Cited

U.S. PATENT DOCUMENTS

| | | | |
|---|---|---|---|
| 2002/0106092 | A1 | 8/2002 | Matsuo |
| 2007/0076902 | A1 | 4/2007 | Master |
| 2008/0031479 | A1 | 2/2008 | Sorgei |
| 2008/0317260 | A1 | 12/2008 | Short |
| 2009/0245539 | A1 | 10/2009 | Vaudrey |
| 2009/0296944 | A1 | 12/2009 | Edwards |
| 2011/0280427 | A1 | 11/2011 | Buyens |
| 2011/0286618 | A1 | 11/2011 | Vandai et al. |
| 2011/0293105 | A1 | 12/2011 | Arie et al. |
| 2012/0300941 | A1 | 11/2012 | Shim et al. |
| 2013/0058488 | A1 | 3/2013 | Cheng et al. |
| 2013/0070945 | A1 | 3/2013 | Fusakawa |

FOREIGN PATENT DOCUMENTS

| | | | |
|---|---|---|---|
| CN | 102318371 | A | 1/2012 |
| CN | 102982804 | A | 3/2013 |
| EP | 2485218 | A2 | 8/2012 |
| JP | 2000-102097 | A | 4/2000 |
| JP | 2002064895 | A | 2/2002 |
| JP | 2010210758 | A | 9/2010 |
| TW | 200818961 | A | 4/2008 |
| WO | 2005101898 | A2 | 10/2005 |
| WO | 2008028484 | A1 | 3/2008 |
| WO | 2008092183 | A1 | 8/2008 |
| WO | 2009152442 | A1 | 12/2009 |
| WO | 2011100802 | A1 | 8/2011 |

OTHER PUBLICATIONS

Kate Gfeller et al., Musical Backgrounds, Listening Habits, and Aesthetic Enjoyment of Adult Cochlear Implant Recipients, Journal of the American Academy of Audiology, Jul./Aug. 2000, pp. 390-406.

Yuval, Review: TDK ST800, Mar. 24, 2012, pp. 1-8.

Wim Buyens et al., A Harmonic/Percussive Sound Separation Based Music Pre-Processing Scheme for Cochlear Implant Users, 21st European Signal Processing Conference, Sep. 9, 2013, pp. 1-5.

International Search Report and Written Opinion for PCT/182014/063050 dated Nov. 26, 2014.

International Search Report and Written Opinion dated Feb. 9, 2010 for International Application No. PCT/AU2009/001649.

Ono et al., Separation of a Monaural Audio Signal into Harmonic/Percussive Components by Complementary Diffusion on Spectrogram, Department of Information Physics and Computing, Graduate School of Information Science and Technology, The University ofTokyo, 7-3-1 Hongo Bunkyo-ku, Tokyo, 113-8656, Japan.

PRE-PROCESSING OF A CHANNELIZED MUSIC SIGNAL

CROSS-REFERENCE TO RELATED APPLICATIONS

This application is a continuation of U.S. patent application Ser. No. 14/329,518 filed Jul. 11, 2014, which claims priority to U.S. Provisional Patent Application No. 61/845,580, filed on Jul. 12, 2013, the entirety of each of which is incorporated herein by reference.

BACKGROUND

Unless otherwise indicated herein, the information described in this section is not prior art to the claims and is not admitted to be prior art by inclusion in this section.

Various types of hearing prostheses provide people with different types of hearing loss with the ability to perceive sound. Hearing loss may be conductive, sensorineural, or some combination of both conductive and sensorineural. Conductive hearing loss typically results from a dysfunction in any of the mechanisms that ordinarily conduct sound waves through the outer ear, the eardrum, or the bones of the middle ear. Sensorineural hearing loss typically results from a dysfunction in the inner ear, including the cochlea, where sound vibrations are converted into neural signals, or any other part of the ear, auditory nerve, or brain that may process the neural signals.

People with some forms of conductive hearing loss may benefit from hearing prostheses such as hearing aids or vibration-based hearing devices. A hearing aid, for instance, typically includes a small microphone to receive sound, an amplifier to amplify certain portions of the detected sound, and a small speaker to transmit the amplified sounds into the person's ear. A vibration-based hearing device, on the other hand, typically includes a small microphone to receive sound and a vibration mechanism to apply vibrations corresponding to the detected sound directly or indirectly to a person's bone or teeth, thereby causing vibrations in the person's inner ear and bypassing the person's auditory canal and middle ear. Examples of vibration-based hearing devices include bone-anchored devices that transmit vibrations via the skull and acoustic cochlear stimulation devices that transmit vibrations more directly to the inner ear.

Further, people with certain forms of sensorineural hearing loss may benefit from hearing prostheses such as cochlear implants and/or auditory brainstem implants. Cochlear implants, for example, include a microphone to receive sound, a processor to convert the sound to a series of electrical stimulation signals, and an array of electrodes to deliver the stimulation signals to the implant recipient's cochlea so as to help the recipient perceive sound. Auditory brainstem implants use technology similar to cochlear implants, but instead of applying electrical stimulation to a person's cochlea, they apply electrical stimulation directly to a person's brain stem, bypassing the cochlea altogether, still helping the recipient perceive sound.

In addition, some people may benefit from hearing prostheses that combine one or more characteristics of the acoustic hearing aids, vibration-based hearing devices, cochlear implants, and auditory brainstem implants to enable the person to perceive sound.

SUMMARY

A person who suffers from hearing loss may also have difficulty perceiving and appreciating music. When such a person receives a hearing prosthesis to help that person better perceive sounds, it may therefore be beneficial to pre-process music so that the person can better perceive and appreciate music. This may be the case especially for recipients of cochlear implants and other such prostheses that do not merely amplify received sounds but provide the recipient with other forms of physiological stimulation to help them perceive the received sounds. Cochlear implants, in particular, have a relatively narrow frequency range with a small number of channels, which makes music appreciation especially challenging for recipients, compared to those using other types of prostheses. Exposing such a cochlear-implant recipient to an appropriately pre-processed music signal may help the recipient better correlate those physiological stimulations with the received sounds and thus improve the recipient's perception and appreciation of music. While the benefits of pre-processing will likely be most noticeable for cochlear-implant recipients, users of other hearing prostheses, including acoustic devices, such as bone conduction devices, middle ear implants, and hearing aids, may also benefit.

The aforementioned pre-processing may be designed to comport with the hearing prosthesis recipient's music listening preferences. For example, a user of a cochlear implant may prefer a relatively simple musical structure, such as one comprising primarily clear vocals and percussion (i.e. a strong rhythm or beat). The user may find a relatively complex musical structure to be difficult to perceive and appreciate. Enhancement of leading vocals facilitates the hearing prosthesis recipient's ability to follow the lyrics of a song, while enhancement of a beat/rhythm facilitates the hearing prosthesis recipient's ability to follow the musical structure of the song. Thus, in this example, pre-processing the music to emphasize the vocals and percussion relative to other instruments would align with the cochlear implant recipient's preferences, as preferred components are enhanced relative to non-preferred components. In the case of a multi-track recording, remixing would be relatively straight-forward; tracks to be emphasized would simply be increased in volume relative to other tracks. However, most musical recordings are not widely available in a multi-track form, and are instead only available as channelized mixes, such as a stereo (two-channel (left and right)) mix or surround-sound mix, for example.

Disclosed herein are methods, corresponding systems, and an audio cable for pre-processing channelized music signals for hearing prosthesis recipients. The disclosed methods leverage the fact that, in channelized recorded music, leading vocal, bass, and drum components are typically mixed in a particular channel or combination of channels. For example, for a stereo signal, leading vocal, bass, and drum components are typically mixed in the center. By extracting and weighting the leading vocal, bass, and drum components according to a recipient's preference, which may be a standard predetermined preference, for example, the user is better able to perceive and appreciate music.

Accordingly, in one respect, disclosed is a method operable by a device, such as a handheld device, phone, computer, hearing prosthesis, or audio cable, for instance. In accordance with the method, a mask is applied to a stereo input signal to extract a center-mixed component from the stereo signal. An output signal comprised of a weighted combination of the extracted center-mixed component and a residual signal comprising a non-extracted part of the stereo input signal is provided as output. The center-mixed component may contain components, such as leading vocals, bass, and/or drums, preferred by hearing prosthesis recipients relative to other components, such as backing vocals or other instruments. The method may further include separating the stereo input signal into percussive components and harmonic components, such that the percussive components include leading vocals. A low-pass filter may be applied before separating the stereo input signal, according to a further aspect. The provided output signal may, for example, be a mono output signal, which may be well-suited to a hearing prosthesis having only a mono input port, or a stereo output signal, which may be well-suited to a bilateral hearing prosthesis or other such device.

In another respect, disclosed is an audio cable for pre-processing a channelized input audio signal to create an output signal for a hearing prosthesis. The audio cable includes an input port for receiving the channelized input audio signal, which has at least two channels, such as a left channel and a right channel. The audio cable also includes an output port, for outputting an output signal, and a filter to extract a portion of the channelized input signal such that the output signal includes a weighted version of the extracted portion of the channelized input signal. The output signal may be a mono output signal or a stereo output signal, for example. A stereo output signal may have particular application for bilateral hearing prostheses.

In yet another respect, disclosed is a method operable by a device, such as a handheld device, phone, computer, hearing prosthesis, or audio cable, for instance. The disclosed method includes creating an audio output signal for a first hearing prosthesis by extracting and enhancing at least one preferred musical instrument component in a channelized audio input signal relative to at least one non-preferred musical instrument component in the channelized audio input signal. In the case where the audio output signal is a stereo audio output signal, the method could further include providing the audio output signal to bilateral hearing prostheses (i.e. the first hearing prosthesis and a second hearing prosthesis). In one embodiment, the audio input signal is a stereo input signal, and the method further includes applying a stereo mask to the stereo input signal to extract the at least one preferred component. Additionally or alternatively, the stereo input signal can be first separated into percussive components and harmonic components before applying the stereo mask.

In yet another respect, disclosed is a method operable by a device, such as a handheld device, phone, computer, hearing prosthesis, or audio cable, for instance. The disclosed method includes creating a residual signal from left and right channels of a stereo signal having left, right, and center channels. The method further includes creating a base output signal by subtracting the residual signal from the stereo signal and creating a final output signal by adding a weighted version of the residual signal to the base output signal.

These as well as other aspects, advantages, and alternatives will become apparent to those of ordinary skill in the art by reading the following detailed description, with reference where appropriate to the accompanying drawings. Further, it should be understood that the description throughout by this document, including in this summary section, is provided by way of example only and therefore should not be viewed as limiting.

DETAILED DESCRIPTION

Figure 1:
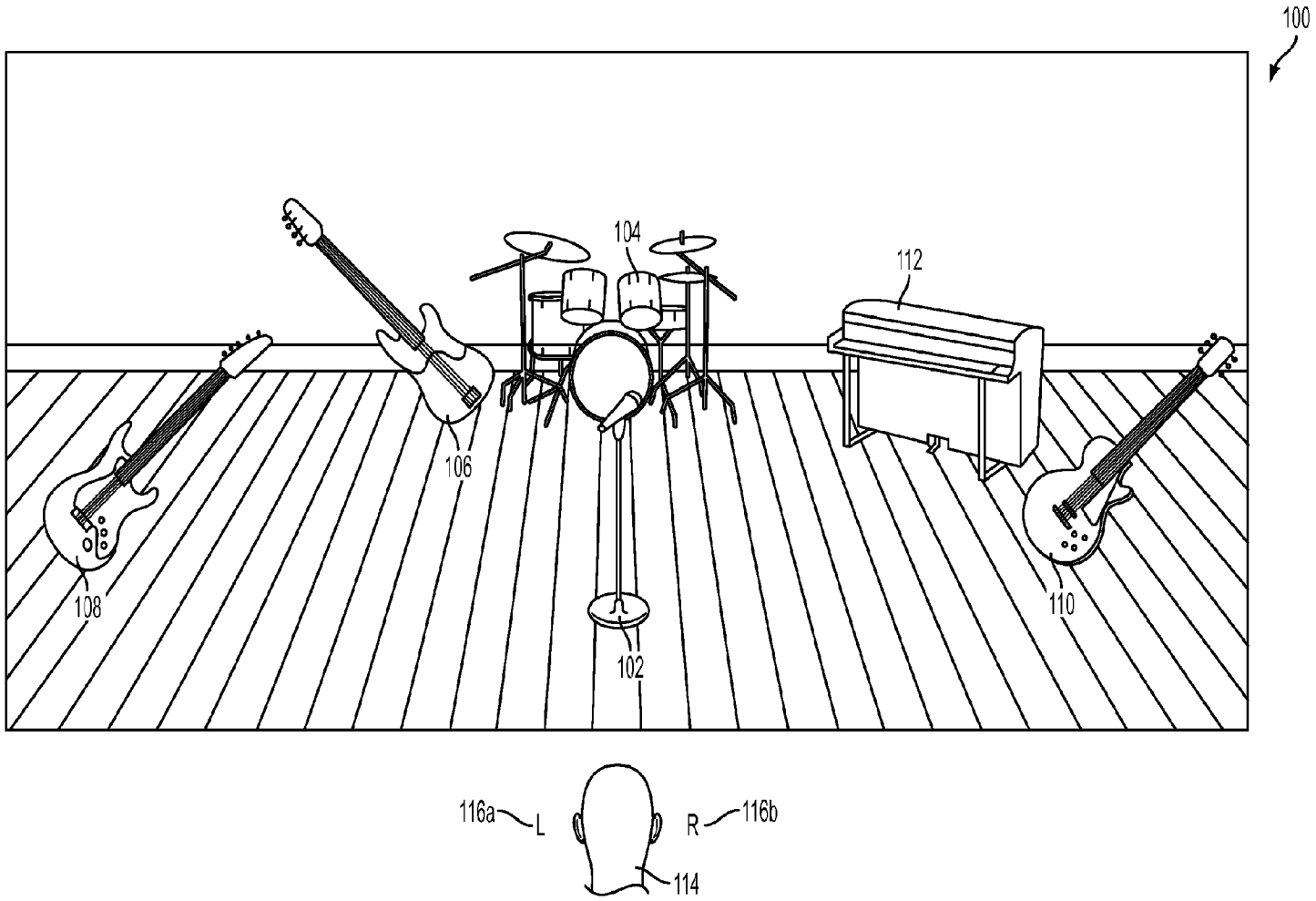
FIG. 1 is a simplified block diagram of a typical placement of musical instruments positioned relative to a listener.

Referring to the drawings, as noted above, FIG. 1 is a simplified block diagram of a typical arrangement 100 of musical instruments positioned relative to a listener 114. As illustrated, the arrangement includes leading vocals 102, percussion (drums) 104, bass 106, lead guitar 108, backup guitar 110, and keyboard 112. In a live-music setting, the listener 114, having left and right ears 116*a-b*, hears the full arrangement of instruments, with each instrumental component originating from a different area of the stage. For the example shown, the leading vocals 102, percussion 104, and bass 106 emanate primarily from the center of the stage. The keyboard 112 is at an intermediate position to the right of the center of the stage. The lead guitar 108 and backup guitar 110 are at the left and right sides of the stage. Backup vocals (not shown) might also be typically placed toward one side or the other in a typical arrangement.

When music is recorded and mixed, such as in a studio or at a live event, the mixer frequently tries to duplicate the relative placement of instrumental components to approximate the experience that a listener (such as the listener 114) would experience at the live event. In one example for a stereo mix, each instrument (including leading vocals) is first recorded as a separate track, so that the mixer can independently adjust (pan) the volume and channel (e.g. left and/or right in a stereo signal) of each track to produce a recorded music track that provides a listener with a sensation of spatially arranged instrumental components. In a second example, a stereo recording is made at a live event using a separate microphone for each channel (e.g. left and right microphones for a stereo signal). By suitably placing the left and right microphones in front of the arrangement (e.g. arrangement 100) of instruments, the recording is, to some extent, approximating what the listener (e.g. listener 114) hears with his two ears (e.g. 116*a-b*). As a further extension to this second example, the live-music recording could also be performed using microphones present in the left and right sides of binaural or bilateral hearing devices. However, in this further extension, the stereo image would be less than ideal unless the listener were positioned in the center (in front of a live band).

According to the first example described above, in which the mixer performs a panning function to create a stereo image having a left channel and a right channel, the mixer may follow a set of panning rules to give the listener the feeling that he or she is looking at (listening to) the band on stage. A typical set of panning rules for a stereo mix may specify, for example, that a kick (bass) drum and snare drum are panned in the center, together with a bass. Tom-tom drums and a high-hat cymbal are panned slightly off center, and the sound recorded by two overhead microphones panned completely to the left or right. Other instruments are panned as they are (or would typically be) located on stage, typically off-center. A piano (keyboard) is typically a stereo signal and is divided between the left and right channels. Finally, the leading vocals are in the center, with backing vocals located completely left or right. At least some of the embodiments described herein utilize aspects of this typical stereo mix to assist in pre-processing music to improve music perception and appreciation for hearing prosthesis recipients. In further embodiments, information pertaining to location of instruments in the stereo (or other channelized) mix is included as metadata embedded in the channelized recording. This metadata can be utilized to extract and enhance preferred components (e.g. leading vocals, bass, and drum) relative to non-preferred (less preferred) components.

As described in detail below, with respect to the accompanying figures, various preferred embodiments set forth herein exploit the center-panning of leading vocal, bass, and drum relative to other instruments in a stereo signal in order to separate (extract) and enhance the leading vocal, bass, and drums relative to those other instruments. This separation and enhancement is applicable to modify commercially recorded stereo music intended for listeners having normal hearing. While instrument-location metadata could be included in the recording itself, as described above, musical recordings might not maintain information pertaining to separate tracks for each instrument, which is one reason why separating the leading vocal, bass, and drum from the stereo signal is advantageous. By relatively enhancing (i.e. pre-processing) the leading vocal, bass, and drums, a hearing prosthesis recipient may experience better perception and appreciation of the music.

Figure 2:
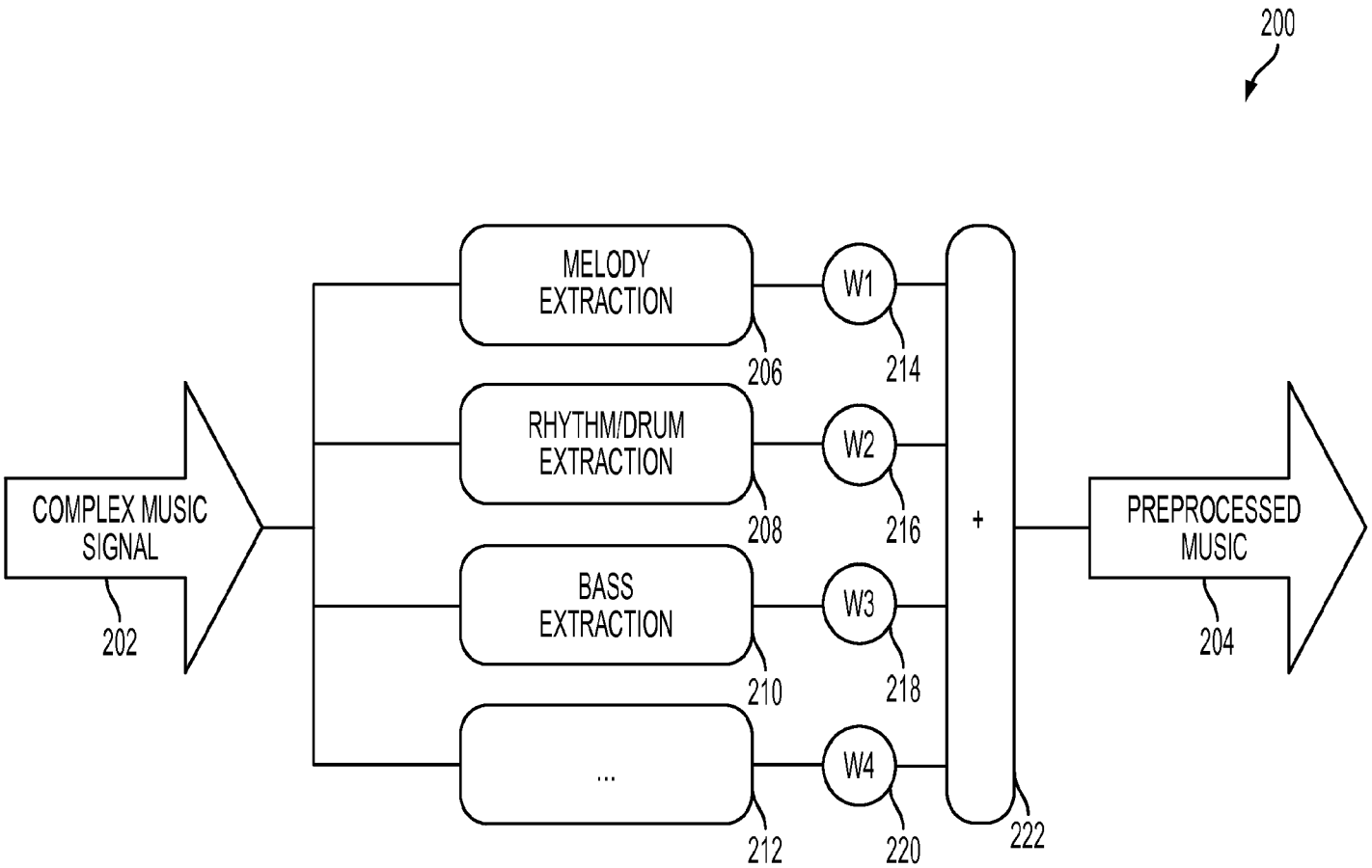
FIG. 2 is a simplified block diagram of a scheme for pre-processing music, in accordance with the present disclosure.

FIG. 2 is next a simplified block diagram of a general scheme 200 for pre-processing music, in accordance with the present disclosure. As was described above with respect to FIG. 1, by separating and enhancing preferred components from a channelized music mix (e.g. a stereo music mix), a pre-processed music signal can be created that may provide for improved perception and appreciation for hearing prosthesis recipients. As shown in FIG. 2, a complex music signal 202 serves as an input. The complex music signal 202 is, for example, a standard stereo music signal (e.g. file, stream, live music microphone input, etc.) that is described as being "complex" due to the relative difficulty a hearing prosthesis recipient (such as a cochlear implant recipient) might experience in trying to comprehend musical aspects of the signal beyond simply the lyrics and bass/rhythm. For example, harmonies, backing vocals, and other melodic or non-melodic instrument contributions might detract from the recipient's ability to perceive and appreciate the music. The recipient might have difficulty following the lyrics or musical structure of a recorded song intended to be heard by a person having normal hearing. According to the pre-processing scheme 200 of FIG. 2, the complex music signal 202 is processed to create a pre-processed music signal 204, which may take the form of an audio file, stream, live music (as processed), or other signal. Note that the term "signal" as used herein is intended to include a static music data file (e.g. mp3 or other audio file) that can be "read" to produce a corresponding music output.

As illustrated in blocks 206-212 of FIG. 2, one or more components are separated or extracted from the complex music signal. An example of such an extraction is described with reference to FIG. 3, below. Block 206 extracts a melody component, which may consist of or comprise a leading vocal component. Block 208 extracts a rhythm/drum component. Block 210 extracts a bass component. Block 212 illustrates that additional components (not shown) may also be extracted. Different types of music may call for different preferences by hearing prosthesis recipients; thus, the components to be extracted may vary based on the type of music embodied in the complex music signal 202. In a preferred embodiment, the extractions are based on an assumption that the complex music signal 202 adheres to common panning rules for a stereo music mix. This assumption should work reasonably well for most pop and rock music, and possibly others.

As illustrated in blocks 214-220, each extracted component is preferably weighted by a respective weighting factor W1-W4. For example, if a first component is to be weighted more heavily than a second component, then the first weighting factor should be larger than the second weighting factor, according to one embodiment. According to one embodiment, weighting factors W1-W4 have values between 0 and 1, where a weighting factor of 0 means the extracted component is completely suppressed and a weighting factor of 1 means the extracted component is unaltered (i.e. no decrease in relative volume). In the example of FIG. 2, weighting factors W1-W3 could have values of 1, while weighting factor W4 could have a value in the range 0.25-0.50. This would effectively emphasize the melody, rhythm/drum, and bass components compared to other components (such as guitar and piano), to make it easier for the hearing prosthesis recipient to comprehend the music. The weighting factors are based on user preference, and may be adjusted by the user "on-the-fly" or may be instead preassigned based on preference testing performed in a clinical or home environment, for example. While the above-described example specifies a preferred range of 0.25-0.5 for W4 with a maximum allowable range of 0-1, other ranges could alternatively be utilized. As illustrated in block 222, the appropriately weighted extracted components are recombined (i.e. summed) to form a composite signal, a form of which serves to provide the pre-processed music signal 204.

Figure 3:
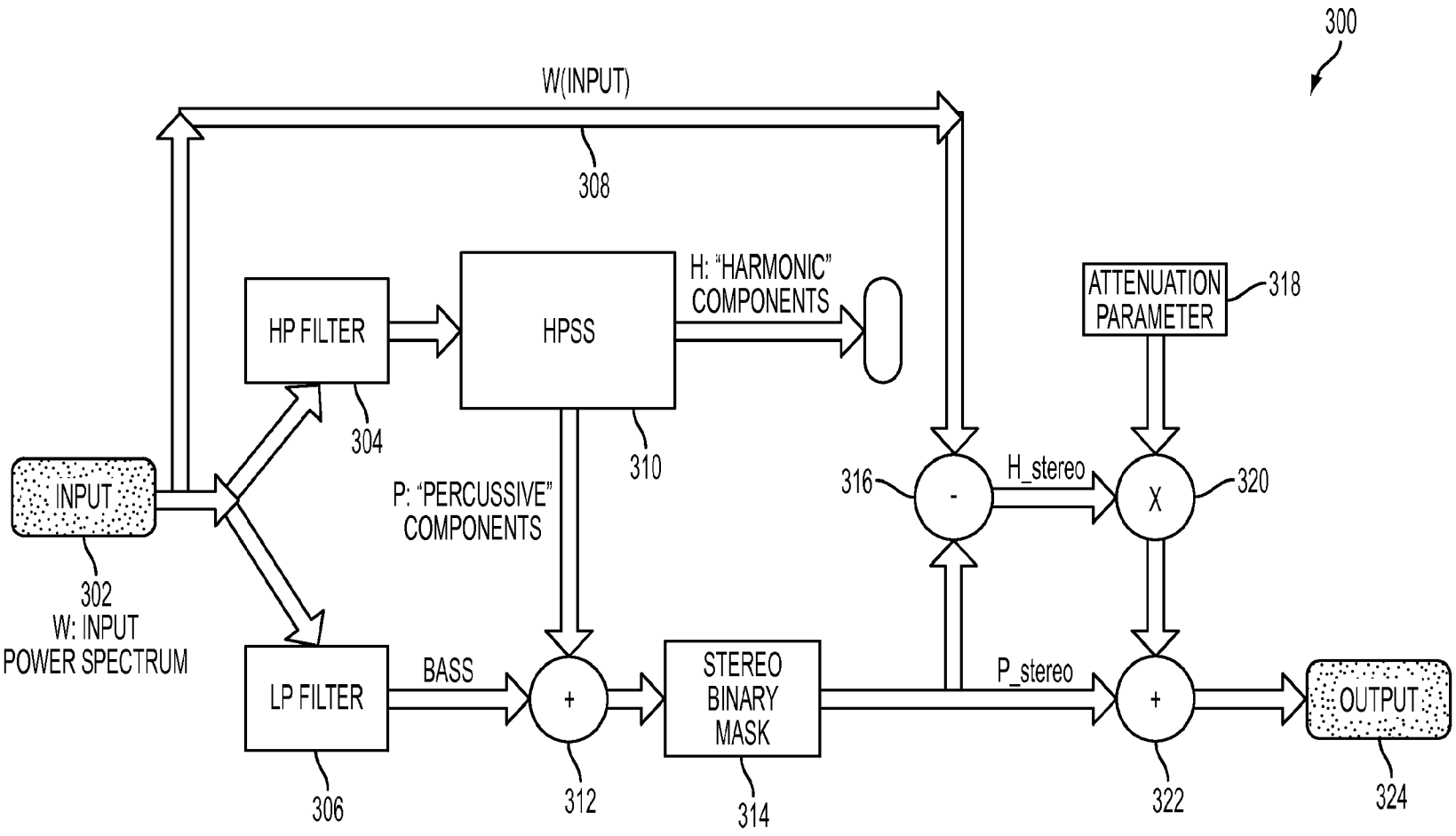
FIG. 3 is a flow chart depicting functions that can be carried out in accordance with a representative method.
Figure 5:
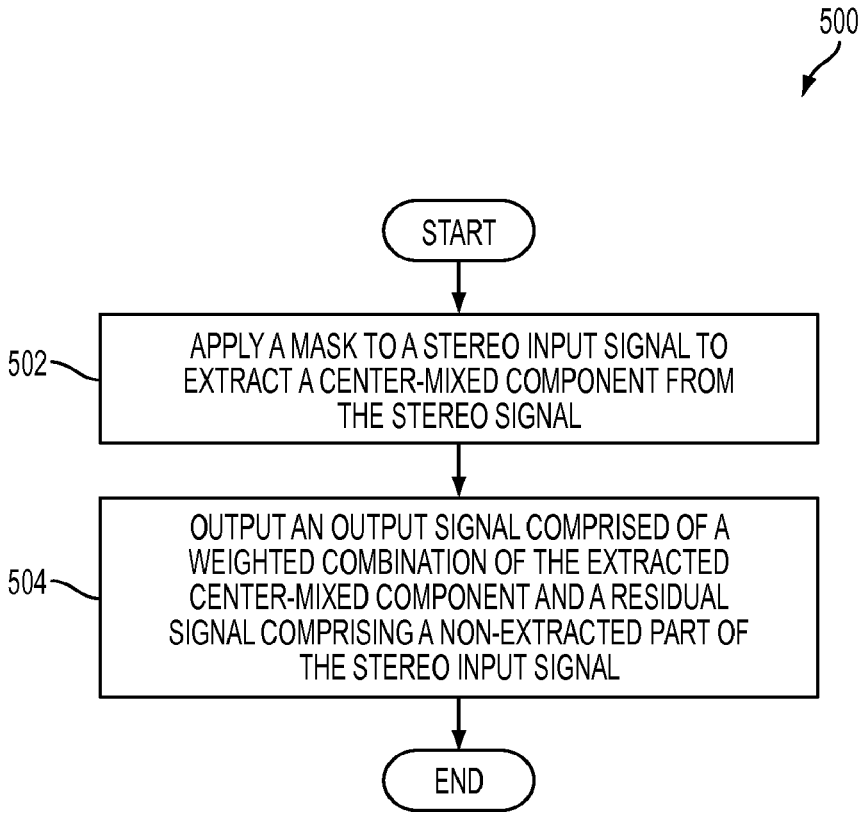
FIG. 5 is a flow chart depicting functions that can be carried out in accordance with a representative method.

The scheme 200 may be implemented using one or more algorithms, such as those illustrated in FIGS. 3 and 5. The choice of algorithm will determine the quality of the extraction (i.e. accuracy of separation between different extracted components) and the amount of latency. In general, more latency is required for better extractions. For an mp3 file, the scheme 200 may be run in near-real-time (i.e. with relatively low latency, such as 500 msec.) to allow a hearing prosthesis recipient to listen to a pre-processed version of the mp3 file. Using an algorithm (such as the one illustrated in FIG. 3) with a latency less than 500 msec. is possible; however, the result would be relatively poor separation between extracted components, due to a smaller block size (fewer iterations). Conversely, an algorithm with a latency of 700-800 msec. might provide better separation between the extracted components, but the longer delay may be less acceptable to the user.

Alternatively, the scheme 200 (or a similar such scheme) may be run in advance on a library of mp3 files to create a corresponding library of pre-processed mp3 files intended for the hearing prosthesis recipient. In such a case, accuracy of extraction and enhancement will likely be more important than latency, and thus, algorithms that are more data-intensive might be preferable.

As yet another alternative, the scheme 200 may be run in near-real-time (i.e. with low latency) on a streamed music source (such as a streamed on-line radio station or other source) to allow the hearing prosthesis recipient to listen to a delayed version of the music stream that is more conducive to the recipient being able to perceive and appreciate musical aspects (e.g. lyrics and/or melody) of the stream.

As still yet another alternative, the scheme 200 may be applied to a live music performance, such as through two or more microphones (e.g. left and right microphones on binaural or bilateral hearing prostheses) to pre-process the live music to produce a corresponding version (with some latency, depending on processor speed and the choice of extraction algorithm used) that allows for better perception and appreciation of the live music performance by the recipient. Application of the scheme 200 to a live-music context preferably includes using an algorithm with very low latency, such as less than 20 msec., which will better allow the hearing prosthesis recipient to concurrently perform lip-reading of a vocalist, for example. In addition, the hearing prosthesis recipient should be physically located in a relatively central location in front of the live-music stage/source (the stereo-recording "sweet spot"), so that the signals from the left and right microphones on the hearing prosthesis provide input signals more amendable to the separation algorithms set forth herein. Other examples, including other file and signal types, are possible as well, and are intended to be within the scope of this disclosure, unless indicated otherwise.

The scheme of FIG. 2 is preferably run as software executed by a processor. For example, the software could take the form of an application on a handheld device, such as a mobile phone, handheld computer, or other device that is preferably in wired or wireless communication with a hearing prosthesis. Alternatively, the software and/or processor could be included as part of the hearing prosthesis itself. This alternative could be particularly suitable to the stereo binary mask algorithm shown in FIG. 5, in which a behind-the-ear (BTE) processor having a stereo input could perform the stereo binary mask. Other alternatives are possible as well. Additional details on the physical implementation of a system and/or device that carries out the methods disclosed herein are provided below.

FIG. 3 is a flow chart depicting functions that can be carried out in accordance with a representative method 300. Although the functions of FIG. 3 are shown in series in the flow chart, one or more of the blocks may, in practice, be continuously carried out in real-time, such as through one or more iterative processes, described below. In addition, one or more blocks may be omitted in various embodiments, depending on the extent of panning in a recording's stereo image, for example. As shown in FIG. 3, at block 302, the method includes providing an input power spectrum W from a stereo input signal, such as an mp3, streamed audio source, stereo microphones from a recording device or bilateral hearing prostheses, etc. While the example of FIG. 3 is described with respect to a stereo input signal, the illustrated method may be equally applicable to other channelized signals having different numbers or configurations of channels. The input power spectrum W is a matrix with time/frequency bins resulting from a short term fourier transform (STFT) of the stereo input signal ((left channel+right channel)/2).

The input power spectrum W from block 302 is filtered by a high-pass filter (block 304) and a low-pass filter (block 306). An unfiltered version of the input power spectrum W from block 302 is utilized elsewhere (to create a residual signal), as will be described in block 316. The output of the low-pass filter (e.g. up to 400 Hz) of block 306 includes bass (low frequency) components that provide more "fullness" and better continuity (less "beating"), which will generally result in an improved listening experience for hearing prosthesis recipients.

Figure 4:
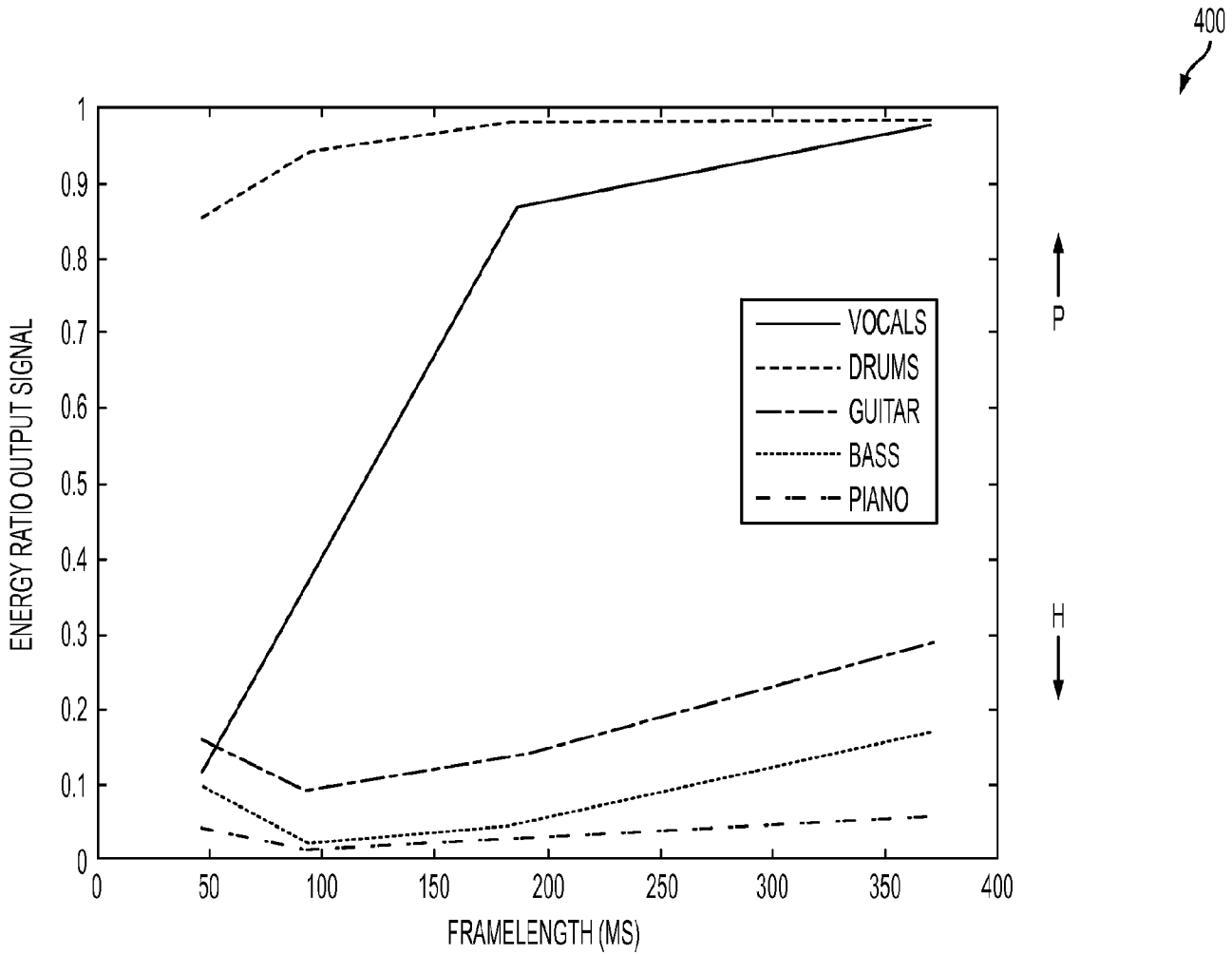
FIG. 4 is a plot illustrating the dependence of harmonic/percussive separation on transform frame length.

The output of the high-pass filter (e.g. above 400 Hz) from block 304 is subjected to a separation algorithm (block 310), to separate out (extract) various musical components. In a preferred embodiment, and as illustrated, the separation algorithm is the Harmonic/Percussive Sound Separation (HPSS) algorithm described by Ono et al., "Separation of a Monaural Audio Signal into Harmonic/Percussive Components by Complementary Diffusion on Spectrogram," Proc. EUSIPCO, 2008, which is incorporated by reference herein in its entirety. Tachibana et al., "Comparative evaluations of various harmonic/percussive sound separation algorithms based on anisotropic continuity of spectrogram," Proc. ICASSP, pp. 465-468, 2012, is also incorporated by reference herein in its entirety. The HPSS algorithm separates the harmonic and percussive components of an audio signal based on the anisotropic smoothness of these components in the spectrogram, using an iteratively-solved optimization problem. The optimization problem is solved by minimizing the cost function J in equation (1) below:

$$J(H, P) = \frac{1}{2\sigma_H^2}\sum_{\tau,\omega}(H_{\tau-1,\omega} - H_{\tau,\omega})^2 + \frac{1}{2\sigma_P^2}\sum_{\tau,\omega}(P_{\tau,\omega-1} - P_{\tau,\omega})^2 \quad (1)$$

under constraints (2) and (3) below:

$$H_{\tau,\omega}^2 + P_{\tau,\omega}^2 = W_{\tau,\omega}^2 \quad (2)$$

$$H_{\tau,\omega} \geq 0,\ P_{\tau,\omega} \geq 0 \quad (3)$$

where H and P are sets of $H_{\tau,\omega}$ and $P_{\tau,\omega}$, respectively, and weights $\sigma_H$ and $\sigma_P$ are parameters to control the horizontal and vertical numerical smoothness in the cost function. Minimization of the cost function J results from minimizing the sum of the time-shifted version of H (harmonic components, horizontal) and the frequency-shifted version of P (percussive components, vertical) through numeric iteration. Constraint (2), above, ensures that the sum of the harmonic and percussive components makes up the original input power spectrogram. Constraint (3), above, ensures that all harmonic and percussive components are non-negative. The result of applying the separation algorithm (310) is to separate the high-pass-filtered signal from block 304 into harmonic components H and percussive components P. As stated above, the HPSS algorithm is iterative (with the iterations being subject to the additional constraint (4) described below with respect to block 314); a few iterations will generally be necessary to reach convergence, in accordance with a preferred embodiment. In addition, temporal-variable tones, such as vocals, can be harmonic or percussive depending on the frame length of the STFT (Short Time Fourier Transform) used in the HPSS algorithm. This frame-length dependence is illustrated in FIG. 4, which shows a plot 400 of the energy ratio of the output signal versus the STFT frame length. As illustrated in the plot 400, for a relatively short frame length, such as 50 msec., vocals are separated into the harmonic components H, while at longer frame lengths, such as 100-500 msec., vocals are separated into the percussive components P. In order to ensure that lead vocals are separated as part of the percussive components P, rather than the harmonic components H, a relatively large frame length (e.g. 100-500 msec.) should be used in calculating the STFT for the HPSS algorithm. Including the lead vocals as part of the percussive components P is advantageous because both the lead vocals and percussion (e.g. drums) are typically musically important (preferred) by recipients of hearing prostheses. The harmonic components H are less preferred, and, as shown in FIG. 3, the harmonic components H are at least temporarily disregarded after application of the separation algorithm of block 310. Other separation algorithms besides the HPSS algorithm or other implementations of HPSS may be used for separation/extraction.

Note that, in FIG. 4, the bass component is illustrated in the lower portion of the plot 400, along with the guitar and piano components, while the vocals and drums are in the upper portion, especially toward the right of the chart, corresponding to increasing frame length. Low-frequency components (like the bass component) are more easily separated by frequency, such as by using a low-pass filter. The other components are more difficult to separate, due to their overlapping frequency ranges. The HPSS algorithm of FIG. 3 is advantageously applied to frequencies above 400 Hz to separate high-frequency components from one another.

The percussive components P resulting from the separation algorithm of block 310 are combined (summed) with the bass (low-frequency) components resulting from the low-pass-filtered input power spectrum W output from block 306.

A stereo binary mask is applied at block 314 to the percussive components P, and, preferably, the low-pass-filtered (block 306) version of the input power spectrum W (block 302). The stereo binary mask identifies the "center" of the stereo image (see formula (12), below), which is where leading vocals, bass, and drum are typically mixed (assuming that the stereo input signal does not contain metadata indicating instrument arrangement; see the discussion infra and supra regarding such metadata). In this respect, the stereo binary mask acts as an additional constraint (i.e. a "center stereo" constraint) on the separation algorithm (e.g. HPSS) of block 310. Using equation (1) and constraints (2) and (3) above for the HPSS algorithm, this additional constraint can be defined as:

$$P_{\tau,\omega} \text{ in the middle of stereo image} \tag{4}$$

As mentioned above, with respect to block 310, this additional constraint is preferably included in the iterative solution of the HPSS algorithm.

The above equations can be solved numerically using the following iteration formulae:

$$P^2_{\tau,\omega} \leftarrow \frac{\beta_{\tau,\omega} W^2_{\tau,\omega}}{(\alpha_{\tau,\omega} + \beta_{\tau,\omega})} \tag{5}$$

$$H^2_{\tau,\omega} \leftarrow \frac{\alpha_{\tau,\omega} W^2_{\tau,\omega}}{(\alpha_{\tau,\omega} + \beta_{\tau,\omega})} \tag{6}$$

where $$\alpha_{\tau,\omega} = (H_{\tau+1,\omega} + H_{\tau-1,\omega})^2 \tag{7}$$

$$\beta_{\tau,\omega} = \kappa^2 (P_{\tau,\omega+1} + P_{\tau,\omega-1})^2 \tag{8}$$

in which κ is a parameter having a value of $\sigma_H^2/\sigma_P^2$, tuned to maximize separation between harmonic and percussive components. In a preferred embodiment, κ has a value of 0.95, which has been found to provide an acceptable tradeoff between separation and distortion.

Including constraint (4), above, the iteration formulae become the following:

$$P^2_{\tau,\omega} \leftarrow \frac{\beta_{\tau,\omega} W^2_{\tau,\omega}}{(\alpha_{\tau,\omega} + \beta_{\tau,\omega})} \tag{9}$$

$$P^2_{\tau,\omega} \leftarrow BM_{stereo} * P^2_{\tau,\omega}, \text{ where } BM_{stereo} \text{ is the binary mask} \tag{10}$$

$$H^2_{\tau,\omega} = W^2_{\tau,\omega} - P^2_{\tau,\omega} \tag{11}$$

with $$BM_{stereo} = \theta * W_{diff} < W_L \text{ and } \theta * W_{diff} < W_R \tag{12}$$

where $W_{diff}$ is the spectrogram of the difference between left channel and right channel. The binary mask preferably consists of a matrix of 1's and 0's, with "1" corresponding to time-frequency bins for which condition ($\theta * W_{diff} < W_L$) & ($\theta * W_{diff} < W_R$) is true, indicating a center-mixed component (e.g. leading vocals, bass, and drums) and "0" for which the condition is false, indicating a non-center-mixed component (e.g. backing vocals and other instruments). The parameter θ is an adjustable parameter to control the angle relative to the center of the stereo image to broaden the considered center-panned area. For example, every instrument can be panned across a range from −100 (left) over 0 (center) to +100 (right). Lower values of θ generally correspond to less attenuation of instruments at wide angles (e.g. panned near −100 or +100) and practically no attenuation of instruments panned at narrower angles. Higher values of θ generally correspond to more attenuation of instruments panned at all angles, except near the center, with the amount of attenuation (suppression) increasing as the panning angle increases. According to a preferred embodiment, θ is chosen to be 0.4, corresponding to an angle of about +/−50 degrees. This angle results in a relatively good separation between different components (e.g. vocals versus guitar).

At block 316, the output of block 314 is subtracted from the input power spectrum W of block 302, leaving a residual signal (preferably after several iterations), shown as H_stereo, corresponding to what was removed from the input power spectrum W. An attenuation parameter (block 318) is then applied to the residual signal at block 320. For example, the attenuation parameter could be one or more adjustable weighting factors that the recipient adjusts to produce a preferred music-listening experience. Sample attenuation parameter settings are 1, 0 db (no attenuation), 0.5 (−6 dB), 0.25 (−12 dB), and 0.125 (−18 dB). Setting and applying the attenuation parameter effectively emphasizes (e.g. increases the volume of) the center of the stereo image of the percussive components P relative to the non-center/non-percussive components. For a typical music recording, this will result in enhanced leading vocals, rhythm (drum), and bass relative to other components, thereby potentially improving a hearing prosthesis recipient's perception and appreciation of music.

Per the above discussion of the iterative process, the P_stereo and H_stereo outputs from blocks 314 and 316, respectively, are updated iteratively. In the current preferred implementation, for example, there are ten iterations before the final P_stereo and H_stereo outputs are passed on to subsequent blocks (i.e. for relative enhancement and/or attenuation). Fewer iterations, while improving latency, typically results in poorer separation between components, making the resulting output signal difficult for a hearing-impaired person to comprehend.

After the attenuation of block 320, the attenuated signal is summed at block 322 with the output of block 314 to produce an output signal 324, preferably in the same format as the original stereo input signal. The output signal 324 could, for example, be a mono signal, which would be suitable for a hearing prosthesis (e.g. a current typical cochlear implant) having a mono input. Alternatively, the output signal 324 could be a stereo signal, which may have application for bilateral hearing prostheses, for example.

FIG. 5 is next another flow chart depicting functions that can be carried out in accordance with a representative method 500 in which a music recording has a broad stereo image. If a stereo music recording is panned extensively, i.e., the recording has a broad stereo image, then the extraction of leading vocals, bass, and drum can be performed using only a stereo binary mask, without a separation algorithm, such as the HPSS algorithm described above with respect to the method 300 of FIG. 3, in accordance with an embodiment. Such an embodiment will have a very low latency, e.g. 20 msec., compared to the several hundred msec. latency associated with implementations of the algorithm of FIG. 3.

As shown in FIG. 5, at block 502, a mask is applied to a stereo input signal having a broad stereo image (i.e. one in which drums and vocals are panned near the center (near 0), while guitar and piano are panned near the left and/or right sides (near +/−100). The method 500 is less applicable to narrower stereo images because separation is more difficult with such signals. The method 300 in FIG. 3 would provide better separation for a narrower stereo image. The stereo input signal processed in block 502 may, for example, be an mp3 file (or other audio file) stored on a hearing prosthesis recipient's handheld device, such as a mobile phone, for example. The other examples of input signals described elsewhere in this disclosure could alternatively be masked in block 502. The stereo input signal is masked to extract a center-mixed component, in a preferred embodiment. For example, an application on the recipient's handheld device (or other device, including the recipient's hearing prosthesis) could subject the stereo input signal to a binary mask such that only a center-mixed component is extracted.

At block 504, an output signal is output. The output signal is comprised of a weighted combination of the extracted center-mixed component and a residual signal comprising a non-extracted part of the stereo input signal. In one example, an extracted center-mixed component is combined with a residual signal in which one or more non-center-mixed components are attenuated (weighted less) relative to the extracted center-mixed component. The attenuation may be through one or more weighting factors, as was described above with respect to FIG. 3.

While the method 500 has been described with respect to the input signal being a stereo input signal having a broad stereo image, other channelized signals having extensive panning (e.g. a surround sound signal in which leading vocals, bass, and drum are in a center channel and backing vocals and less "important" or preferred instruments are panned towards one of the surround channels) would also be suitable candidates for applying a method in accordance with the concepts of the method 500 in FIG. 5.

Moreover, while the example of FIG. 5 included an application on the recipient's handheld device executing the method 500, a different device could alternatively be used. In particular, since the method 500 is less computationally intensive than the method 300 of FIG. 3, the method 500 may be a candidate for implementation in the hearing prosthesis itself, where the hearing prosthesis' processor performs the masking function. In such a case, latency would be much smaller than with the method 300, and a less powerful processor could be used.

The methods described herein, including the methods shown in FIGS. 2, 3, and 5 and their variations, are operable by one or more devices. For example, the device may be a smart phone or tablet computer running a software application to pre-process an input audio signal. Alternatively, the device may be a different type of handheld device, phone, computer, or other general-purpose or specialized apparatus or system capable of performing one or more processing functions. The device may further be a hearing prosthesis having a built-in processor and a stereo input or a pair of bilateral hearing prostheses having a stereo input. Each of the devices mentioned above preferably comprises at least one processor, memory, input and output ports, and an operating system stored in the memory (or other storage) running on the at least one processor. Where the device is a device other than a hearing prosthesis, the device preferably includes an output port for communicating with an input port of a hearing prosthesis. Such an output port may be a wired or wireless (e.g. RF, IR, Bluetooth, WiFi, etc.) connection, for example. The above devices may be configured to run software or firmware, or a combination thereof. Alternatively, the device may be entirely hardware-based (e.g. dedicated logic circuitry), without the need to execute software to perform the functions of the methods described herein. As yet another alternative, the device may be an audio cable having integral hardware (e.g. a filter, dedicated logic circuitry, or processor running software) built-in. Such an audio cable may be a specialized cable intended for use with a hearing prosthesis, such as variation of, e.g., a TV/HiFi cable.

Figure 6:
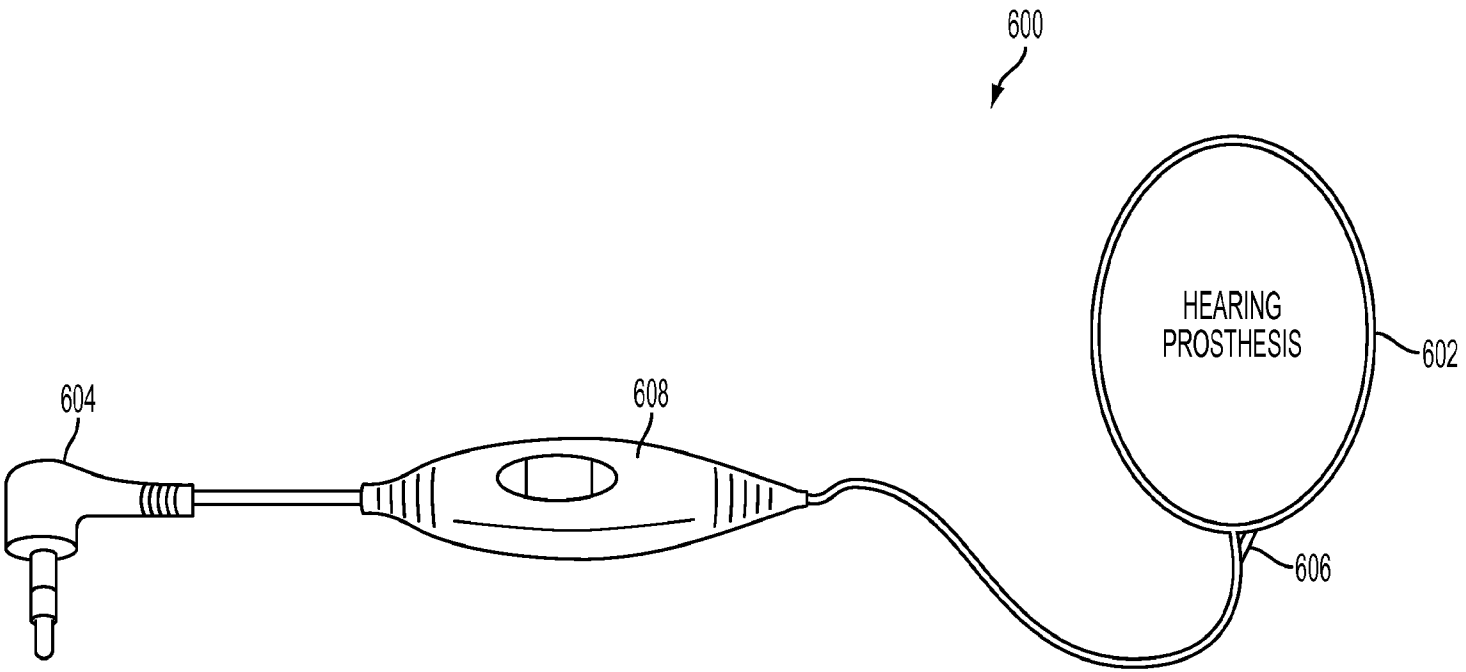
FIG. 6 is a simplified block diagram illustrating an audio cable that may be used to pre-process an input audio signal for a hearing prosthesis.

FIG. 6 is a simplified block diagram illustrating an audio cable 600 that may be used to pre-process an input audio signal for a hearing prosthesis 602. As illustrated, in addition to a collection of insulated wires, the audio cable includes a first plug 604 (input port) for connecting into an audio-out or headphone jack of audio equipment (e.g. a television, stereo, personal audio player, etc.) to receive a channelized input audio signal, such as an input stereo signal. The audio cable also includes a second plug 606 (output port) for connecting to an accessory port of a hearing prosthesis, such as a cochlear implant BTE (behind-the-ear) unit, to output a pre-processed output audio signal to the hearing prosthesis. The second plug 606 may be a mono plug for outputting a mono output audio signal to the hearing prosthesis, or it may be a stereo plug for outputting a stereo output audio signal to bilateral hearing prostheses.

The audio cable also includes an electronics module 608 containing electronics such as volume-control electronics and isolation circuitry, for example. In accordance with a preferred embodiment, the electronics module 608 additionally includes a filter or other electronics to extract a portion of the channelized input audio signal such that the output signal includes a weighted version of the extracted portion of the channelized input audio signal. Such a filter may, for example, implement the masking function described with reference to FIG. 3, by extracting a center-mixed portion of a stereo signal. This may be accomplished by, for example, comparing the signals on the left and right channels to identify components that are common on both signals, indicating that they are mixed in the center of the stereo signal. The electronics module 608 preferably also includes a user interface to allow the hearing prosthesis recipient to adjust weighting factors, such that the output audio signal includes a weighted version of an extracted portion of the channelized input audio signal to be applied to an extracted portion of the channelized input audio signal. Alternatively, weighting could be performed without user input, by simply increasing the volume of the extracted portion relative to a non-extracted portion.

The above discussion references several types of input files, signals, and streams that may be pre-processed in accordance with the concepts described herein. Reference was also made to the possibility of including metadata in a song recording, in order to specify a number of possible parameters, such as which instruments are played, how panning (e.g. stereo panning) is performed, etc. For example, a digital data file corresponding to a recorded (and mixed) song might consist of one or more packet headers or other data constructs that specify these parameters at the beginning of, or throughout, the song. With knowledge of how this metadata is contained in such a recording, a device receiving or playing the file (e.g. as an input signal) can potentially identify the relative placement of instruments used for panning. This identified placement can be used to improve (e.g. decrease latency and/or improve accuracy) the separation/enhancement process of one or more of the method set forth herein. In particular, for example, the method 300 illustrated in FIG. 3 could potentially be simplified to remove the separation algorithm 310 (since such separation would be possible by simply referencing the metadata), instead placing more emphasis on the mask of block 314. Other examples are possible as well.

While many of the above examples are described in the context of a stereo signal, the concepts set forth herein are applicable to other channelized signals and, unless otherwise specified, the claims are intended to encompass a full range of channelized signals beyond just stereo signals. For example, surround sound, CD (compact disc), DVD (digital video disc), Super Audio CD, and others are intended to be included within the realm of signals to which various described embodiments apply.

Exemplary embodiments have been described above. It should be understood, however, that numerous variations from the embodiments discussed are possible, while remaining within the scope of the invention.

I claim:

1. A method comprising:

applying a mask to a stereo input signal to extract a center-mixed component from the stereo signal; and generating an output signal comprised of a weighted combination of the extracted center mixed component and a residual signal, wherein the residual signal comprises a non-extracted component of the stereo input signal.

2. The method of claim 1, wherein the center-mixed component comprises at least one of drums, bass, and leading vocals.

3. The method of claim 2, wherein the center-mixed component comprises each of drums, bass, and leading vocals.

4. The method of claim 1, further comprising separating a percussive component from the stereo input signal, such that the percussive component includes leading vocals, and wherein applying the mask to the stereo input includes applying the mask to the percussive component.

5. The method of claim 4, further comprising applying a high pass filter to the stereo input signal, and wherein separating the percussive component includes separating the percussive component from the high-pass filtered stereo input signal.

6. The method of claim 4, further comprising applying a low-pass filter to the stereo input signal, and wherein the output signal includes the low-pass filtered stereo input signal.

7. The method of claim 6, wherein applying the mask to the stereo input signal includes applying the mask to a combined signal comprised of the low-pass filtered stereo input signal and the percussive component.

8. The method of claim 1, wherein the output signal is a mono output signal, further comprising providing the mono output signal to a hearing prosthesis.

9. The method of claim 1, wherein the output signal is a stereo output signal, further comprising providing the stereo output signal to bilateral hearing prostheses.

10. The method of claim 1, wherein generating the output signal comprised of the weighted combination of the extracted center-mixed component and the residual signal comprises:

weighting the extracted center-mixed component by a first weighting factor; and weighting the residual signal by a second weighting factor, wherein the first weighting factor is different from the second weighting factor.

11. The method of claim 10, wherein the first weighting factor has a value of approximately 1 in a range of 0 to 1, and wherein the second weighting factor has a value of approximately 0.25-0.5 in the range of 0 to 1.

12. A method for creating an audio output signal for a hearing prosthesis, the method comprising:

separating a preferred musical instrument component from a channelized audio input signal; and enhancing separation of the preferred musical instrument component by applying a mask to the separated preferred musical instrument component.

13. The method of claim 12, wherein the audio output signal is a mono audio output signal, further comprising providing the audio output signal to the hearing prosthesis.

14. The method of claim 12, wherein the audio output signal is a stereo audio output signal further comprising providing the audio output signal to bilateral hearing prostheses comprising a first hearing prosthesis and a second hearing prosthesis.

15. The method of claim 12, wherein the channelized audio input signal is a stereo input signal, and wherein applying the mask further comprise applying a stereo mask to the separated preferred musical instrument component.

16. The method of claim 15, wherein the stereo mask masks components that are outside a middle portion of a stereo image associated with the stereo input signal.

17. The method of claim 15, further comprising separating the stereo input signal into percussive components and harmonic components, wherein the preferred musical instrument component includes the percussive components.

18. The method of claim 17 further comprises:

high-pass filtering the stereo input signal prior to the separating, wherein separating the preferred musical instrument component includes separating the preferred musical instrument component from the high-pass filtered stereo input signal;

low-pass filtering the stereo input signal prior to the applying the mask, wherein the mask is applied to a combination of the percussive components and the low-pass-filtered stereo input signal; and weighting the masked combination relative to a residual signal comprising at least the harmonic components to create the audio output signal.

19. The method of claim 12, wherein the at least one preferred musical instrument component includes leading vocals and drums.

20. The method of claim 12, wherein the preferred musical instrument component is a first preferred musical instrument component, further comprising separating a second preferred musical component from the channelized audio input signal, and wherein applying the mask includes applying the mask to a combination of the first and second preferred musical instrument components.

* * * * *